US008115721B2

(12) United States Patent
Yoneyama

(10) Patent No.: US 8,115,721 B2
(45) Date of Patent: Feb. 14, 2012

(54) DISPLAY DATA RECEIVING CIRCUIT AND DISPLAY PANEL DRIVER HAVING CHANGEABLE INTERNAL CLOCK AND SYCHRONIZATION MECHANISMS

(75) Inventor: Teru Yoneyama, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1019 days.

(21) Appl. No.: 11/822,234

(22) Filed: Jul. 3, 2007

(65) Prior Publication Data

US 2008/0007508 A1 Jan. 10, 2008

(30) Foreign Application Priority Data

Jul. 7, 2006 (JP) ..... 2006-188132

(51) Int. Cl.
*G09G 3/36* (2006.01)

(52) U.S. Cl. ..... 345/98; 345/100

(58) Field of Classification Search ..... 345/98, 345/100

See application file for complete search history.

(56) References Cited

U.S. PATENT DOCUMENTS

| | | | | |
|---|---|---|---|---|
| 5,550,874 | A * | 8/1996 | Lee | 375/354 |
| 5,859,669 | A * | 1/1999 | Prentice | 348/469 |
| 5,892,552 | A * | 4/1999 | Kim | 348/478 |
| 6,373,414 | B2 * | 4/2002 | Koga et al. | 341/100 |
| 7,227,522 | B2 * | 6/2007 | Fujimoto et al. | 345/87 |
| 7,243,254 | B1 * | 7/2007 | Kuroodi et al. | 713/600 |
| 7,532,190 | B2 * | 5/2009 | Lin et al. | 345/100 |
| 2002/0041532 | A1 * | 4/2002 | Watanabe et al. | 365/219 |
| 2002/0101947 | A1 * | 8/2002 | Sumiyoshi | 375/376 |
| 2005/0057483 | A1 * | 3/2005 | Sekido et al. | 345/100 |

FOREIGN PATENT DOCUMENTS

| | | |
|---|---|---|
| JP | 9-244587 | 9/1997 |
| JP | 10-97226 | 4/1998 |
| JP | 2000-182399 | 6/2000 |

* cited by examiner

*Primary Examiner* — Chanh Nguyen
*Assistant Examiner* — Kwang-Su Yang
(74) *Attorney, Agent, or Firm* — McGinn IP Law Group, PLLC

(57) ABSTRACT

A display data receiving circuit of the present invention includes a PLL circuit 25 which generates internal clock signal ICLK having an integral multiple of the frequency of differential clock signals CLK and /CLK in response to differential clock signals CLK and /CLK, and a serial/parallel conversion circuit 23 which receives serial data signal transmitting display data in synchronization with the internal clock signal ICLK, and generates parallel data signal by executing serial/parallel conversion for the serial data signal. The serial/parallel conversion circuit 23 is configured to be able to execute either a single edge operation, which receives serial data signals in response to one of a rising edge and a falling edge of the internal clock signal ICLK, or a double edge operation, which receives serial data signals in response to both of a rising edge and a falling edge of the internal clock signal ICLK. Further, the PLL circuit 25 is configured to be able to change the frequency of the internal clock signal ICLK.

18 Claims, 8 Drawing Sheets

| | CNT1 | CNT2 | OPERATION OF S/P CONVERSION CIRCUIT | OPERATION OF PLL CIRCUIT (CLOCK REGENERATION CIRCUIT) | USED DATA LINES |
|---|---|---|---|---|---|
| XGA | "H" | "H" | SINGLE | x8 | DATA0,DATA1 |
| VGA | "H" | "H" | SINGLE | x8 | DATA0,DATA1 |
| HVGA | "L" | "H" | DOUBLE | x4 | DATA0,DATA1 |
| QVGA | "L" | "L" | DOUBLE | x8 | DATA0 |

DISPLAY DATA RECEIVING CIRCUIT AND DISPLAY PANEL DRIVER HAVING CHANGEABLE INTERNAL CLOCK AND SYCHRONIZATION MECHANISMS

BACKGROUND OF THE INVENTION

1. Field of the Invention

An aspect of the present invention relates to a display data receiving circuit and a display panel driver, and more specifically, to a display data receiving circuit for receiving display data serially transferred in a display apparatus, and a display panel driver including the display data receiving circuit.

2. Description of Related Art

In a display apparatus using a liquid crystal display panel and other display panels, a data transfer method of display data (tone data) is determined according to the specifications of the display panel, specifically, the number of pixels. For example, in a display apparatus providing a display panel whose number of pixels is large such as a display panel of XGA (extended graphic array: 1024×768 pixels), because it is necessary to transfer display data at the high data transfer rate, data transfer of the display data is performed in the high clock frequency. On the other hand, in a display apparatus providing a display panel whose number of pixels is small such as a display panel of QVGA (quarter video graphic array: 320×240 pixels), data transfer of the display data is performed in the low clock frequency. Other resolutions refer to VGA (video graphic array: 640×480 pixels) and HVGA (half VGA: 480×320 pixels). Total number of pixels of XGA, VGA, HVGA, and QVGA refer to DXGA, DVGA, DHVGA, and DQVGA, respectively, and the following relation is valid:

$$DXGA>DVGA>DHVGA>DQVGA.$$

Generally, the data transfer rate can be also controlled so that a transmitter-receiver circuit operates in synchronization with only one edge of a rising edge and a falling edge of a clock signal, or both edges. As known widely, DRAM (dynamic random access memory) may be configured to execute data input/output according to both of a rising edge and a falling edge of clock signal, and such DRAM is referred to as DDR-SDRAM (double data rate-synchronous dynamic random access memory). It is known that DDR-SDRAM has such an advantage that the data transfer rate of DDR-SDRAM is twice as compared with DRAM (such DRAM is referred to as SDR-SDRAM (single data rate-SDRAM)) which executes data input/output according to one of a rising edge and a falling edge of a clock signal. Japanese Patent Laid-Open No. 2000-182399 discloses DRAM which can execute both of an operation which synchronizes with only one of a rising edge and a falling edge of a clock signal, and an operation which synchronizes with both edges.

In a display apparatus, particularly, a display apparatus used for a portable device, reduction of the power consumption is one of the important problems. One approach for this problem is to change a data transfer method of display data according to the display size of a display panel. Japanese Patent Laid-Open No. 9-244587 discloses a liquid crystal display control circuit which changes a data transfer method of display data according to the display size specification of a liquid crystal display panel. Such a well-known liquid crystal display control circuit is a circuit for transmitting display data and control signals to a driver control LSI (Large scale integrated circuit) which controls a column driver and a common driver. The liquid crystal display control circuit provides three display control LSIs which can be controlled independently. Display data is supplied from each of the three display control LSIs to the driver control LSI, and control signals are supplied from one of the three display control LSIs to the driver control LSI. When the display panel (e.g. XGA display panel) whose number of pixels is large is driven, all of the three display control LSIs are used. On the other hand, one or two of the three display control LSIs are selected and used for the display panel whose number of pixels is small. Display data is supplied from the selected display control LSIs to the driver control LSI. If one or two of the three display control LSIs are selected and used, the power consumption of a liquid crystal display apparatus can be reduced in case that the display panel whose number of pixels is small is used.

Japanese Patent Laid-Open No. 10-97226 discloses another approach for reducing the power consumption of a liquid crystal display apparatus. In this liquid crystal display apparatus, a high frequency oscillating circuit which is a source of a high frequency timing signal used for transferring display data operates intermittently. Specifically, if a rewrite of display data is directed from MPU (micro processing unit), the oscillation of the high frequency oscillating circuit is started, and if transferring display data is terminated, the oscillation of the high frequency oscillating circuit is stopped. Thereby, the power consumption of a liquid crystal display apparatus is reduced.

However, in the above existing liquid crystal display apparatus, there is such a problem that the electric power consumed while display data is being received can not be reduced. In the liquid crystal display control circuit disclosed in Japanese Patent Laid-open No. 9-244587, while the power consumption of the display control LSI which transmits display data is reduced, the power consumption of the driver control LSI which receives display data is not reduced.

On the other hand, in the liquid crystal display apparatus disclosed in Japanese Patent Laid-open No. 10-97226, while the power consumption of the display panel driver while data transfer is standing by can be reduced certainly, the power consumption of the display panel driver while display data is being transferred can not be reduced.

The problem of the power consumption is particularly important when a display data receiving circuit which receives display data is designed so as to be able to change the transfer rate of display data. When the transfer rate of display data can be changed, the display data receiving circuit is required to be designed so as to be able to receive display data certainly when the transfer rate of display data is maximum. However, such a design, generally, uselessly increases the power consumption in case that the transfer rate of display data is slow.

SUMMARY OF THE INVENTION

A display data receiving circuit (11) according to the present invention provides clock regeneration circuits (25 and 25A) which generate a internal clock signal (ICLK) which has the an integral multiple of the frequency of an external clock signals (CLK and /CLK) in response to the external clock signals (CLK, /CLK), and a serial/parallel conversion circuit (23) which receives serial data signals (IDATA0 and IDATA1) which transmit display data in synchronization with the internal clock signal (ICLK), and executes serial/parallel conversion for the serial data signals (IDATA0 and IDATA1) and generates parallel data signals. The serial/parallel conversion circuit (23) is configured to be able to execute both of a single edge operation which receives the serial data signals (IDATA0 and IDATA1) in response to one of a rising edge and a falling edge of the internal clock signal (ICLK), and a double edge operation which receives the serial data signals (IDATA0, IDATA1) in response to both of a rising edge and a falling edge of the internal clock signal (ICLK). The clock regeneration circuits (25 and 25A) are configured to be able to change the frequency of the internal clock signal (ICLK).

In the display data receiving circuit (11) configured in such way, certainty for receiving display data is improved by causing the serial/parallel conversion circuit (23) to execute a single edge operation when display data is transmitted at the fast transfer rate. On the other hand, the power consumption can be reduced by causing the serial/parallel conversion circuit (23) to execute a double edge operation and setting the frequency of the internal clock signal (ICLK) to the low frequency (preferably, half a frequency) when display data is transmitted at the slow transfer rate.

According to the present invention, such a display data receiving circuit is provided so that display data can be received certainly when display data is transmitted at the fast transfer rate, and also, the power consumption can be reduced when display data is transmitted at the slow transfer rate.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF THE PREFERRED EMBODIMENTS

The First Exemplary Embodiment

Figure 1:
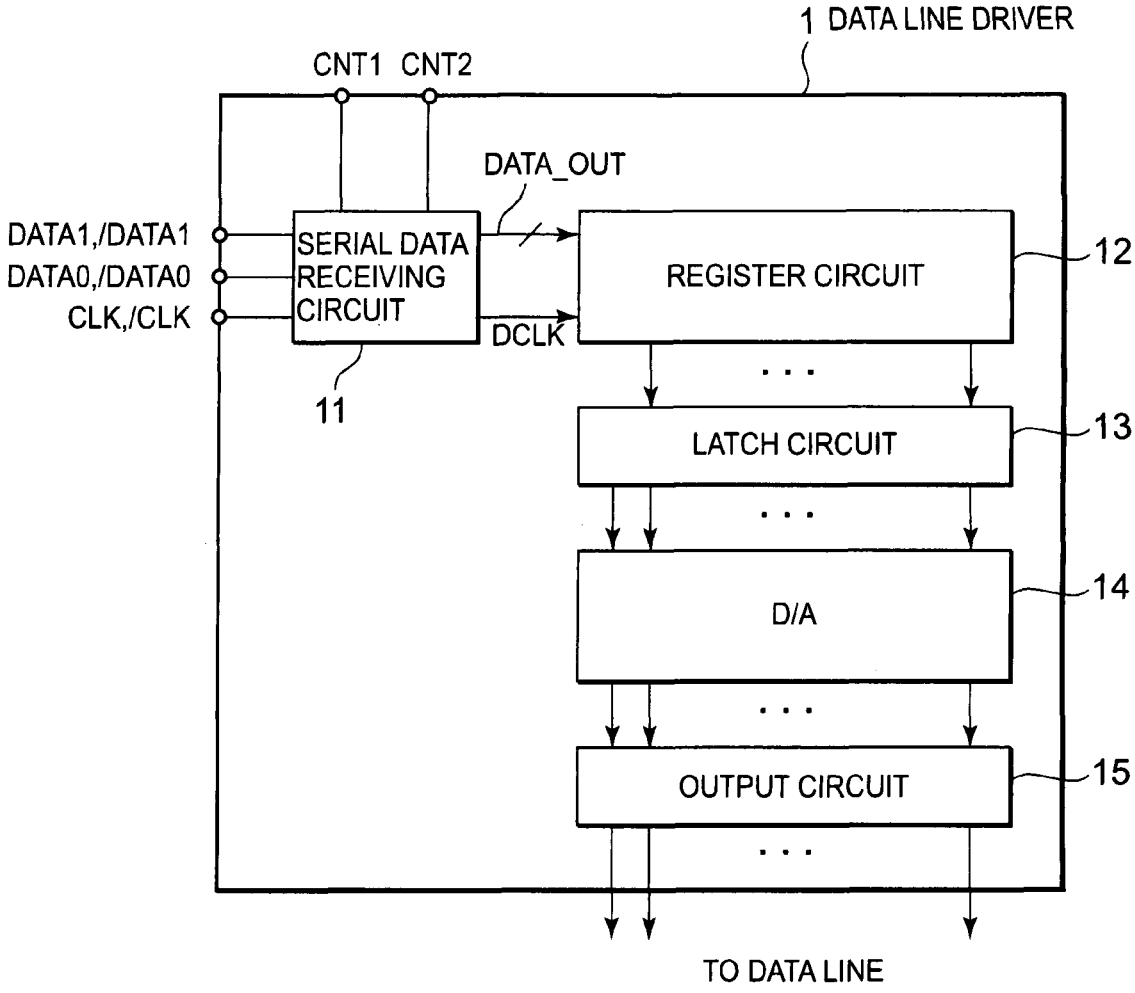
FIG. 1 is a block diagram illustrating a configuration of a data line driver according to the first exemplary embodiment of the present invention.

FIG. 1 is a block diagram illustrating a configuration of a data line driver 1 according to the first exemplary embodiment of the present invention. The data line driver 1 of the first exemplary embodiment is used to drive data lines of a liquid crystal display panel, and includes a serial data receiving circuit 11 corresponding to a display data receiving circuit of the present invention, a register circuit 12, a latch circuit 13, a D/A converter 14, and an output circuit 15.

The serial data receiving circuit 11 is a circuit which receives differential serial data signals DATA0, /DATA0, DATA1, and /DATA1, and converts them to n-bit parallel data signal DATA_OUT corresponding to them. The differential serial data signals DATA0 and /DATA0 are a pair of differential signals used for transmitting serially a part of display data displaying tone of each pixel of a liquid crystal display panel, and the differential serial data signals DATA1 and /DATA1 are a pair of differential signals used for transmitting serially a remaining part of the display data. On the other hand, the parallel data signal DATA_OUT is a CMOS level signal used for transmitting display data in parallel. In the first exemplary embodiment, tone of each pixel is expressed with n bits. That is, the display data is n-bit data.

Further, the serial data receiving circuit 11 has a function which receives the differential clock signals CLK and /CLK and generates a dot clock signal DCLK to control timing of the data line driver 1. The dot clock signal DCLK is a signal in synchronization with the parallel data signal DATA_OUT, and has the same frequency as the differential clock signals CLK and /CLK. The parallel data signal DATA_OUT is transferred to the register circuit 12 in synchronization with the dot clock signal DCLK.

The timing for receiving the differential serial data signals DATA0, /DATA0, DATA1, and /DATA1 is controlled by the differential clock signals CLK and /CLK. The frequency of the differential clock signals CLK and /CLK is lower than the frequency (i.e., the data transfer rate) of the differential serial data signals DATA0, /DATA0, DATA1, and /DATA1. In the first exemplary embodiment, the frequency of the differential clock signals CLK and /CLK is n/2 times as high as the frequency of the differential serial data signals DATA0, /DATA0, DATA1, and /DATA1. It should be noted that n is, as described above, the number of bits used for expressing tone of each pixel (i.e. bit width of the parallel data signal DATA_OUT). The differential serial data signals DATA0, /DATA0, DATA1, and /DATA1 are received in synchronization with the differential clock signals CLK and /CLK.

In the first exemplary embodiment, while such a configuration is described that display data is transmitted by two sets of differential serial data signals, when signals except display data, for example, control signals, etc. are transmitted as overlapped on differential serial data signals, or when relatively large part of display data is transmitted by one of the two sets of differential serial data signals, and relatively small part of the display data is transmitted by other set, the frequency of the differential serial data signals is increased by what is needed. Even in this case, the frequency of the differential clock signals CLK and /CLK is maintained to be same as the frequency of the dot clock signal DCLK. And, when all display data is transmitted by only one set of differential serial data signals DATA0 and /DATA0, the frequency of the differential clock signals CLK and /CLK is set to be n times as high as the frequency of differential serial data signals DATA0 and /DATA0, even in this case, the frequency of the differential clock signals CLK and /CLK is maintained to be same as the frequency of the dot clock signal DCLK.

Operations of the serial data receiving circuit 11 are controlled by signal levels of external control signals CNT1 and CNT2. The external control signals CNT1 and CNT2 are signals supplied to external connection pins of the data line driver 1. The external control signals CNT1 and CNT2 are fixed at either one of "High" level or "Low" level by external wirings of the data line driver 1.

The parallel data signal DATA_OUT and the dot clock signal DCLK are inputted from the serial data receiving circuit 11 to the register circuit 12, and display data transmitted by the parallel data signal DATA_OUT is stored temporarily as latched in synchronization with the dot clock signal DCLK. The register circuit 12 is configured to be able to store same number of display data as the number of one line of pixels driven by the target data line driver 1 (e.g. the number of data lines driven by the data line driver 1). For example, when the data line driver 1 is configured to drive 384 data lines, the register circuit 12 is configured to be able to store 384 display data.

The latch circuit 13 receives one line of display data from the register circuit 12 and transfers it to the D/A converter 14.

The D/A converter 14 converts the one line of display data received from the latch circuit 13 to each corresponding tone voltage.

The output circuit 15 is configured with a voltage follower circuit, and drives a data line connected to the circuit at a driving voltage corresponding to the tone voltage received from the D/A converter 14.

Figures 2, 3:
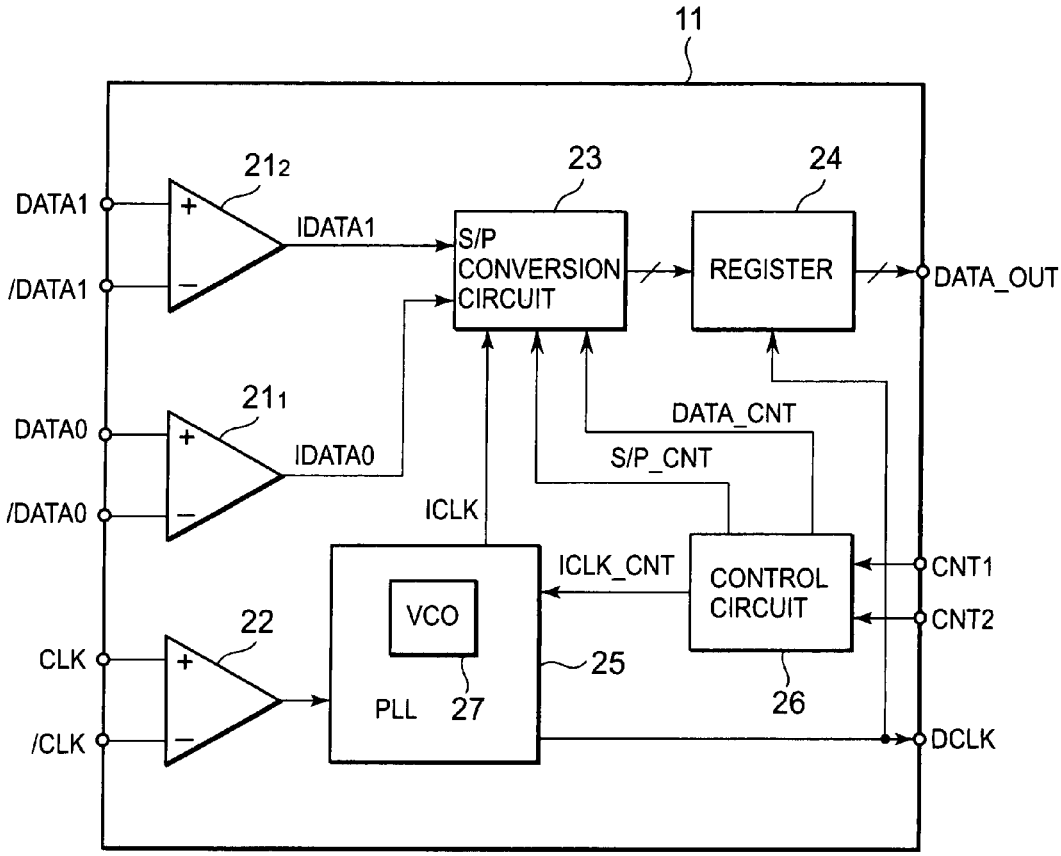
FIG. 2 is a block diagram illustrating a configuration of a serial data-receiving circuit according to the first exemplary embodiment.
FIG. 3 is a table describing an operation of a serial data receiving circuit according to the first exemplary embodiment.

FIG. 2 is a block diagram illustrating a configuration of the serial data receiving circuit 11. The serial data receiving circuit 11 includes comparators $\mathbf{21}_1$, $\mathbf{21}_2$, and 22, a serial/parallel conversion circuit 23, a register 24, a PLL circuit 25, and a control circuit 26.

The comparator $\mathbf{21}_1$ converts the differential serial data signals DATA0 and /DATA0 to a serial data signal IDATA0 of CMOS level. In the same way, the comparator $\mathbf{21}_2$ converts the differential serial data signals DATA1 and /DATA1 to a serial data signal IDATA1 of CMOS level.

The comparator 22 generates a clock signal of CMOS level from the differential clock signals CLK and /CLK.

The serial/parallel conversion circuit 23 is a circuit which receives the serial data signals IDATA0 and IDATA1 from the comparators $\mathbf{21}_1$ and $\mathbf{21}_2$ in synchronization with an internal clock signal ICLK supplied from the PLL circuit 25, and converts them to parallel data. The serial/parallel conversion circuit 23 has two functions described below.

First, the serial/parallel conversion circuit 23 is configured to be able to execute both of a single edge operation which receives serial data signals in response to one of a rising edge and a falling edge of the internal clock signal ICLK, and a double edge operation which receives serial data signals in response to both of a rising edge and a falling edge of the internal clock signal ICLK. The single edge operation and the double edge operation are changed according to a control signal S/P_CNT supplied from the control circuit 26.

Second, the serial/parallel conversion circuit 23 is configured to be able to execute both of an operation which receives serial data signals from both of the comparators $\mathbf{21}_1$, $\mathbf{21}_2$, and an operation which receives serial data signals from only one comparator. The receiving operation of the serial/parallel conversion circuit 23 is changed in response to a control signal DATA_CNT supplied from a control circuit 26.

The register 24 latches parallel data signal outputted from the serial/parallel conversion circuit 23 in response to the dot clock signal DCLK, and outputs the latched parallel data signal as parallel data signal DATA_OUT to the outside of the serial data receiving circuit 11.

A PLL circuit 25 is a clock regeneration circuit which generates an internal clock signal ICLK by executing the frequency multiplying for a clock signal of CMOS level outputted from the comparator 22. The frequency of the internal clock signal ICLK generated by the PLL circuit 25 (i.e., a multiple number of the frequency multiplying executed by the PLL circuit 25) is controlled by a control signal ICLK_CNT supplied from the control circuit 26. More specifically, the PLL circuit 25 is configured to execute either operation of $\alpha$ times frequency multiplying and $\alpha/2$ times frequency multiplying in response to the control signal ICLK_CNT. In the first exemplary embodiment, $\alpha$ is set to n/2. $\alpha$ may be an arbitrary positive number. It should be noted that n is the number of bits of display data as described above. A voltage controlled oscillator (VCO) 27 is installed in the PLL circuit 25, and the VCO 27 is used to generate the internal clock signal ICLK.

The control circuit 26 generates control signals S/P_CNT, DATA_CNT, and ICLK_CNT according to signal levels of the external control signals CNT1 and CNT2, and thereby, controls the serial/parallel conversion circuit 23 and the PLL circuit 25. Specifically, according to the external control signal CNT1, the control circuit 26 changes a single edge operation and a double edge operation in the serial/parallel conversion circuit 23, and changes the frequency of the internal clock signal ICLK generated by the PLL circuit 25. Further, according to the external control signal CNT2, the control circuit 26 changes such an operation that the serial/parallel conversion circuit 23 receives the serial data signals from both of the comparators $\mathbf{21}_1$, $\mathbf{21}_2$, and such an operation that the serial/parallel conversion circuit 23 receives the serial data signals from only one comparator.

One feature of the serial data receiving circuit 11 of FIG. 2 is that it can operate so as to receive data certainly when the transfer rate of display data is fast, and operate with the less power consumption when the transfer rate of display data is slow. Operations of the serial data receiving circuit 11 are changed by the external control signals CNT1 and CNT2. Operations of the serial data receiving circuit 11 will be described in detail below.

FIG. 3 is a table illustrating an example of operations of the serial data receiving circuit 11 in case that n, the number of bits, is 16 bits. Because the transfer rate of display data is fast when the number of pixels of a liquid crystal display panel is large, the serial data receiving circuit 11 is set so as to receive data fast and certainly. In the first exemplary embodiment, the serial data receiving circuit 11 is set so as to receive data fast and certainly when liquid crystal display panels of XGA and VGA are driven.

Specifically, when liquid crystal display panels of XGA and VGA are driven, both of the external control signals CNT1 and CNT2 are set to "High" level. According to the fact that the external control signal CNT1 is set to "High" level, the serial/parallel conversion circuit 23 executes a single edge operation which receives the serial data signals IDATA0 and IDATA1 in response to only one of a rising edge and a falling edge of the internal clock signal ICLK, further, the PLL circuit 25 generates the internal clock signal ICLK by executing a times (.alpha./2 times) frequency multiplying. Further, according to that the external control signal CNT2 is set to "High" level, the serial/parallel conversion circuit 23 receives the serial data signals IDATA0 and IDATA1 from both of the comparators $\mathbf{21}_1$ and $\mathbf{21}_2$.

It should be noted that the single edge operation has such an advantage that serial data signals are received more certainly than the double edge operation which receives the serial data signals IDATA0 and IDATA1 in response to both of a rising edge and a falling edge of the internal clock signal ICLK. It is necessary to provide an enough set up/hold time so that the serial/parallel conversion circuit 23 receives the serial data signals IDATA0 and IDATA1 certainly. However, in the double edge operation, if a duty ratio of the internal clock signal ICLK is out of 50%, the set up/hold time decreases notably. The decrease of the set up/hold time is a problem particularly when the serial data signals IDATA0 and IDATA1 are required to be received at the high speed. Thus, when the serial data signals IDATA0 and IDATA1 are received at the high speed, the serial/parallel conversion circuit 23 is set so as to execute the single edge operation.

On the other hand, when the number of pixels of a liquid crystal display panel is relatively small, the transfer rate of display data is relatively slow, and in this case, the serial data receiving circuit 11 is set so as to execute operations for reducing the power consumption. In the first exemplary embodiment, when liquid crystal display panels of HVGA and QVGA are driven, the serial data receiving circuit 11 is set so as to execute operations for reducing the power consumption.

More specifically, when a liquid crystal display panel of HVGA is driven, the external control signal CNT1 is set to "Low" level, and the external control signal CNT2 is set to "High" level. According to that the external control signal CNT1 is set to "Low" level, the serial/parallel conversion circuit 23 executes a double edge operation, further, the PLL circuit 25 executes $\alpha/2$ times ($\alpha/4$ times) frequency multiplying. According to such operations, the frequency of the internal clock signal ICLK can be reduced into half, and the power consumption of the PLL circuit 25 can be reduced while the frequency in which the serial/parallel conversion circuit 23 receives the serial data signals IDATA0 and IDATA1 is being maintained to be a times ($\alpha/2$ times) as high as the frequency of the differential clock signals CLK and /CLK. When the transfer rate of display data is relatively slow (i.e. when the frequency of the differential clock signals CLK and /CLK is low), the decrease of set up/hold time is not a problem, so that it is effective to reduce the power consumption by causing the serial/parallel conversion circuit 23 to execute a double edge operation.

Further, when a liquid crystal display panel of QVGA whose number of pixels is further small is driven, both of the external control signals CNT1 and CNT2 are set to "Low" level. In this case, as in case that a liquid crystal display panel of HVGA is driven, the serial/parallel conversion circuit 23 executes a double edge operation, and the PLL circuit 25 executes .alpha. times (.alpha./2 times) frequency multiplying. Further, according to that the external control signal CNT2 is set to "Low" level, the serial/parallel conversion circuit 23 executes an operation which receives serial data signals only from the comparators $\mathbf{21}_1$. The comparators $\mathbf{21}_2$ is caused to be inactive, thereby, the power consumption is further reduced.

Figure 4:
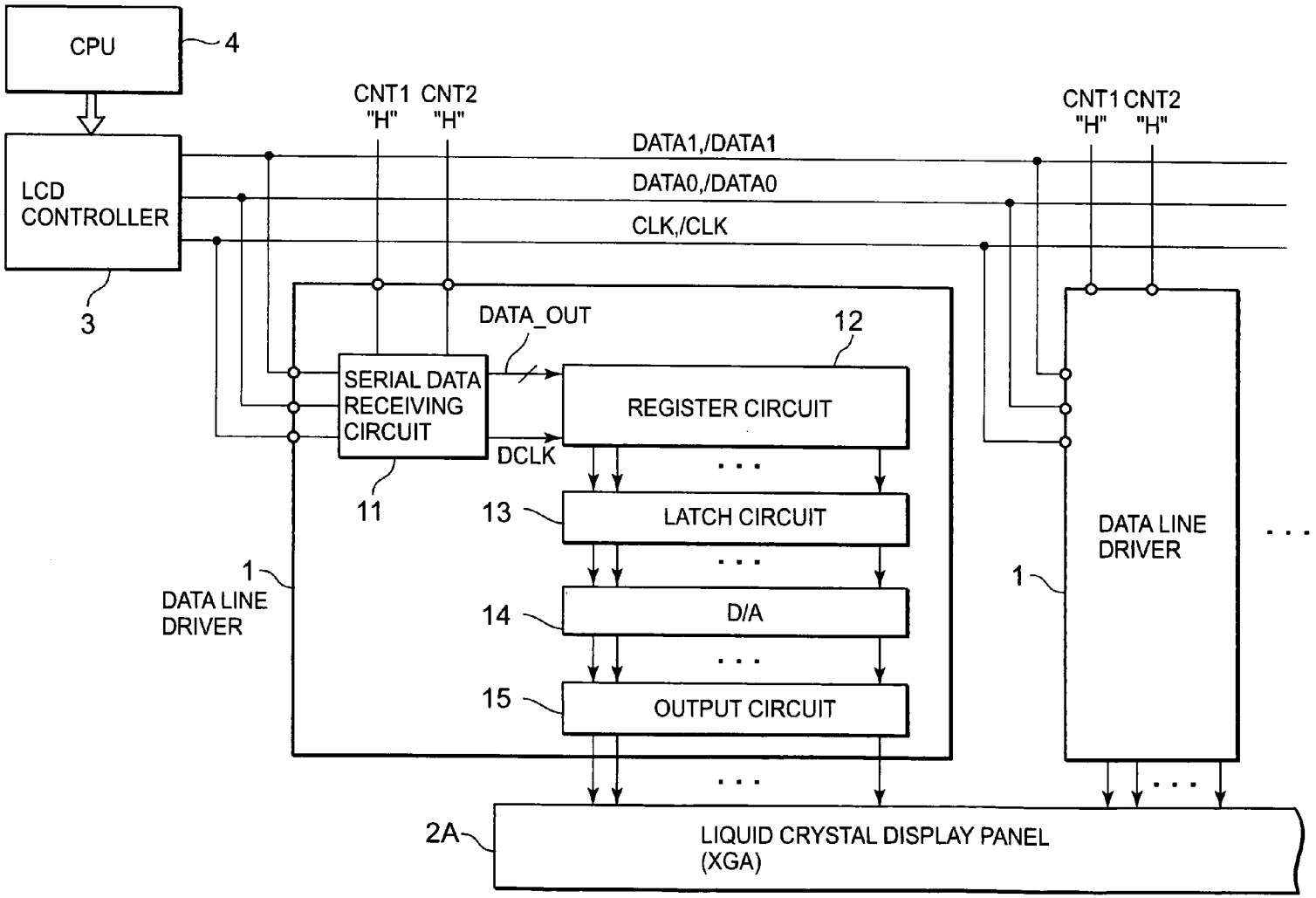
FIG. 4 is a block diagram illustrating one installation embodiment of a data line driver according to the first exemplary embodiment.

It is preferable that such a serial data receiving circuit 11 is integrated in the data line driver 1 configured to be able to drive plural kinds of liquid crystal display panels. FIG. 4 is a block diagram illustrating an installation example of the data line driver 1 in case that a liquid crystal display panel 2A of XGA is installed in a liquid crystal display apparatus. Plural data line drivers 1 are installed in the liquid crystal display apparatus, and such data line drivers 1 are controlled by a LCD controller 3. The LCD controller 3 receives display data from CPU 4 (or image processing apparatus such as DSP (digital signal processor) and others), and supplies the display data to each data line driver 1 with the differential serial data signals DATA0, /DATA0. DATA1, and /DATA1. In addition, the LCD controller 3 supplies control signals such as the differential clock signals CLK and /CLK and others to each data line driver 1. Plural data line drivers 1 drive each pixel of the liquid crystal display panel 2A of XGA in response to the differential serial data signals DATA0, /DATA0. DATA1, and /DATA1 supplied from the LCD controller 3.

In such an installation embodiment, both of the external control signals CNT1 and CNT2 are set to "High" level, thereby, the serial data receiving circuit 11 is set so as to receive data fast and certainly.

Figure 5:
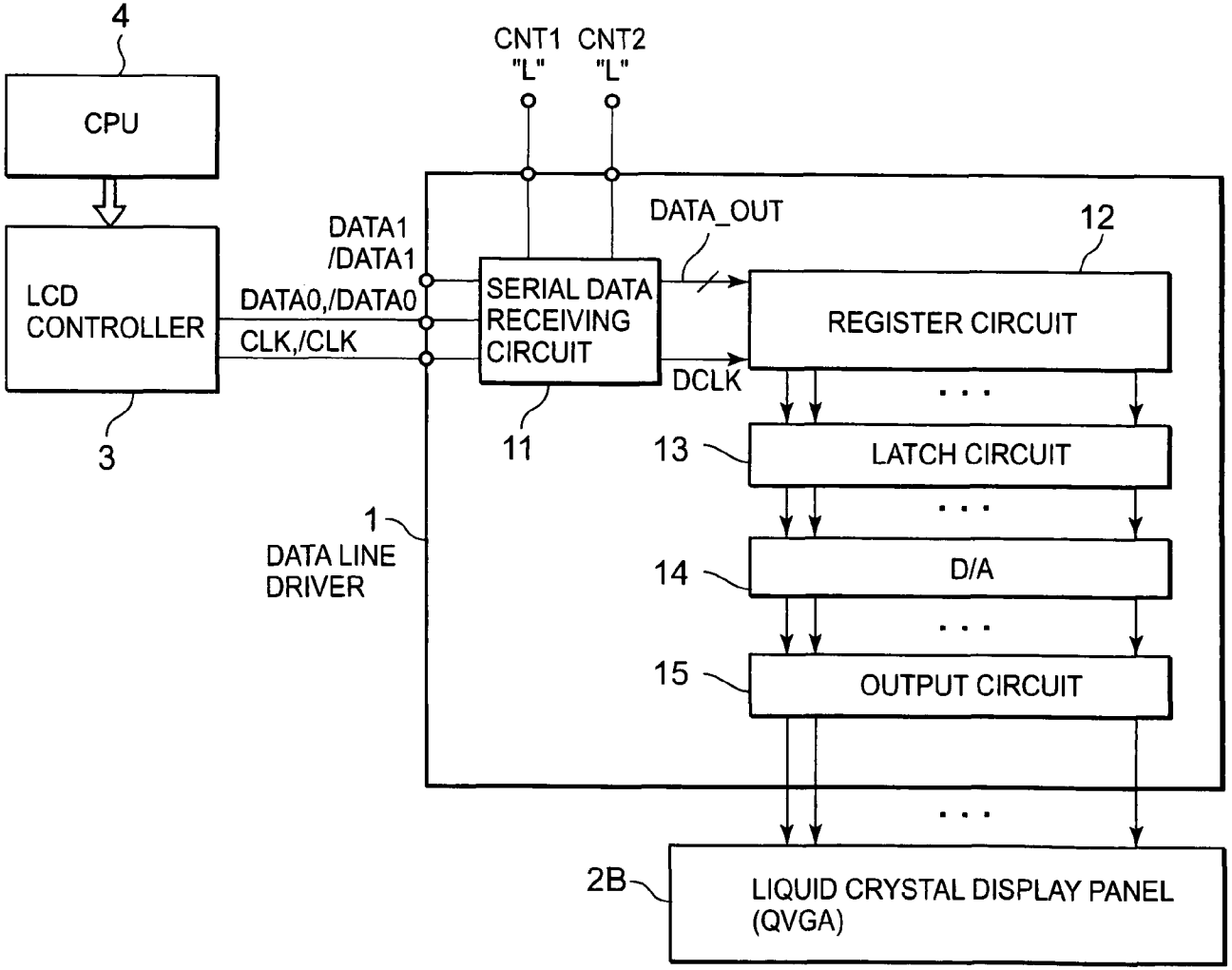
FIG. 5 is a block diagram illustrating another installation embodiment of a data line driver according to the first exemplary embodiment.

On the other hand, FIG. 5 is a block diagram illustrating an installation example of the data line driver 1 in case that a liquid crystal display panel 2B of QVGA is installed in a liquid crystal display apparatus. In the liquid crystal display apparatus of FIG. 5, the liquid crystal display panel 2B of QVGA is driven by the single data line driver 1. In this case, while the LCD controller 3 supplies the differential serial data signals DATA0 and /DATA0 to the data line driver 1, the differential serial data signals DATA1 and /DATA1 are not used. In such an installation embodiment, both of the external control signals CNT1 and CNT2 are set to "Low" level, thereby, the serial data receiving circuit 11 is set so as to operate with the less power consumption.

As described above, in the first exemplary embodiment, the serial data receiving circuit 11 corresponding to kinds of plural liquid crystal display panels is installed in the data line driver 1. The serial data receiving circuit 11 of the first exemplary embodiment can be caused to receive display data fast and certainly by setting the external control signals CNT1 and CNT2 appropriately when the number of pixels of a liquid crystal display panel is large and the transfer rate of display data is fast. On the other hand, the serial data receiving circuit 11 can be caused to operate with the less power consumption by setting the external control signals CNT1 and CNT2 appropriately when the number of pixels of a liquid crystal display panel is small and the transfer rate of display data is slow.

Figure 6:
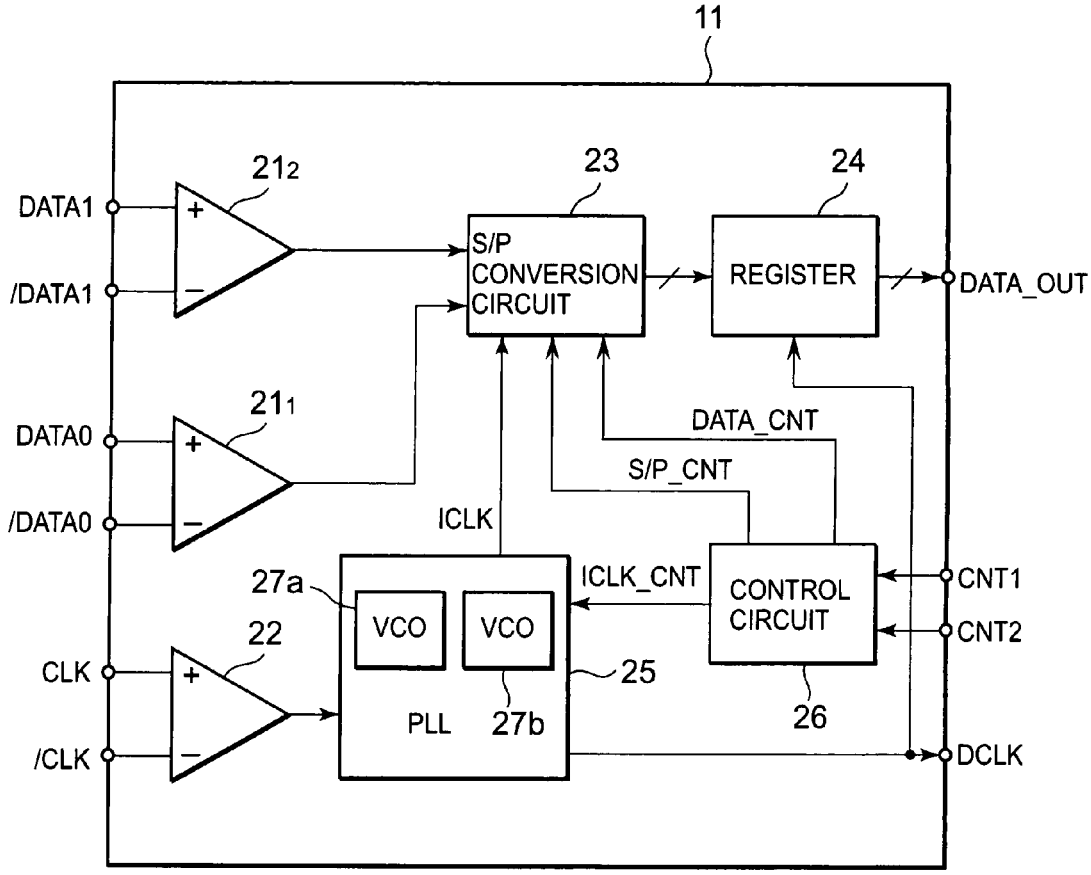
FIG. 6 is a block diagram illustrating another configuration of a serial data receiving circuit.

FIG. 6 is a block diagram illustrating a configuration of a modified example of the serial data receiving circuit 11. In the serial data receiving circuit 11 of FIG. 6, two sets of VCO 27A and VCO 27B are mounted in the PLL circuit 25. One set, VCO 27A, is used when the internal clock signal ICLK whose frequency is higher than a prescribed frequency is generated, and other set, VCO 27B, is used when the internal clock signal ICLK whose frequency is lower than the prescribed frequency is generated. Generally, VCO has the frequency in which it operates best. In a configuration of FIG. 6, two sets of VCOs are provided to the PLL circuit 25, so that VCO can be caused to operate in the best frequency within a wider frequency range of the internal clock signal ICLK as compared to a single VCO.

Figure 7:
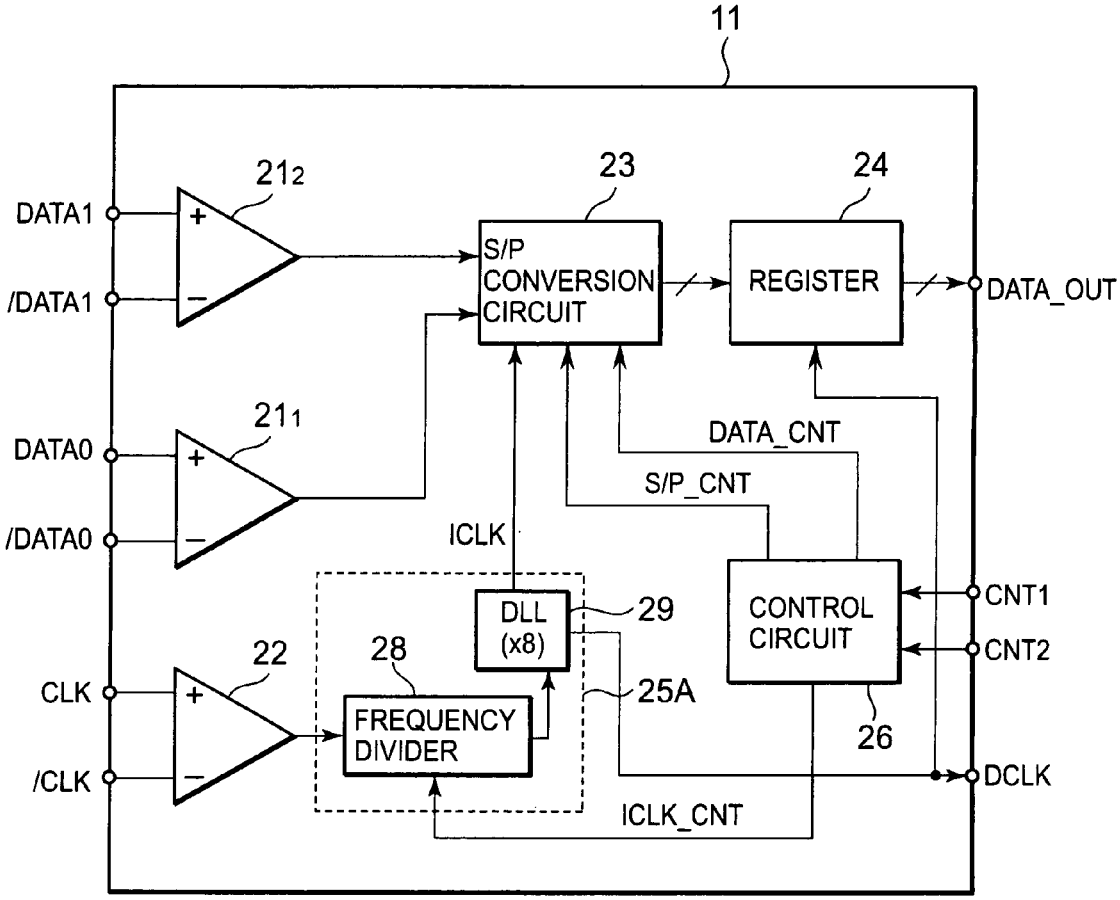
FIG. 7 is a block diagram illustrating further another configuration of a serial data receiving circuit.

Another clock regeneration circuit can be used instead of the PLL circuit 25. For example, as illustrated in FIG. 7, a clock regeneration circuit 25A configured with a frequency divider 28 and a digital lock loop (DLL) 29 can be used instead of the PLL circuit 25. In the serial data receiving circuit 11 of FIG. 7, the frequency divider 28 divides by 2 the frequency of a clock signal of CMOS level received from the comparator 22, and outputs the frequency-divided clock signal or a clock signal of the same frequency as that of the received clock signal according to the control signal ICLK_CNT supplied from the control circuit 26. The DLL 29 executes n times frequency multiplying for the clock signal received from the frequency divider 28. The clock regeneration circuit 25A with such a configuration can execute either operation of n times frequency multiplying and n/2 times frequency multiplying according to the control signal ICLK_CNT.

The Second Exemplary Embodiment

Figure 8:
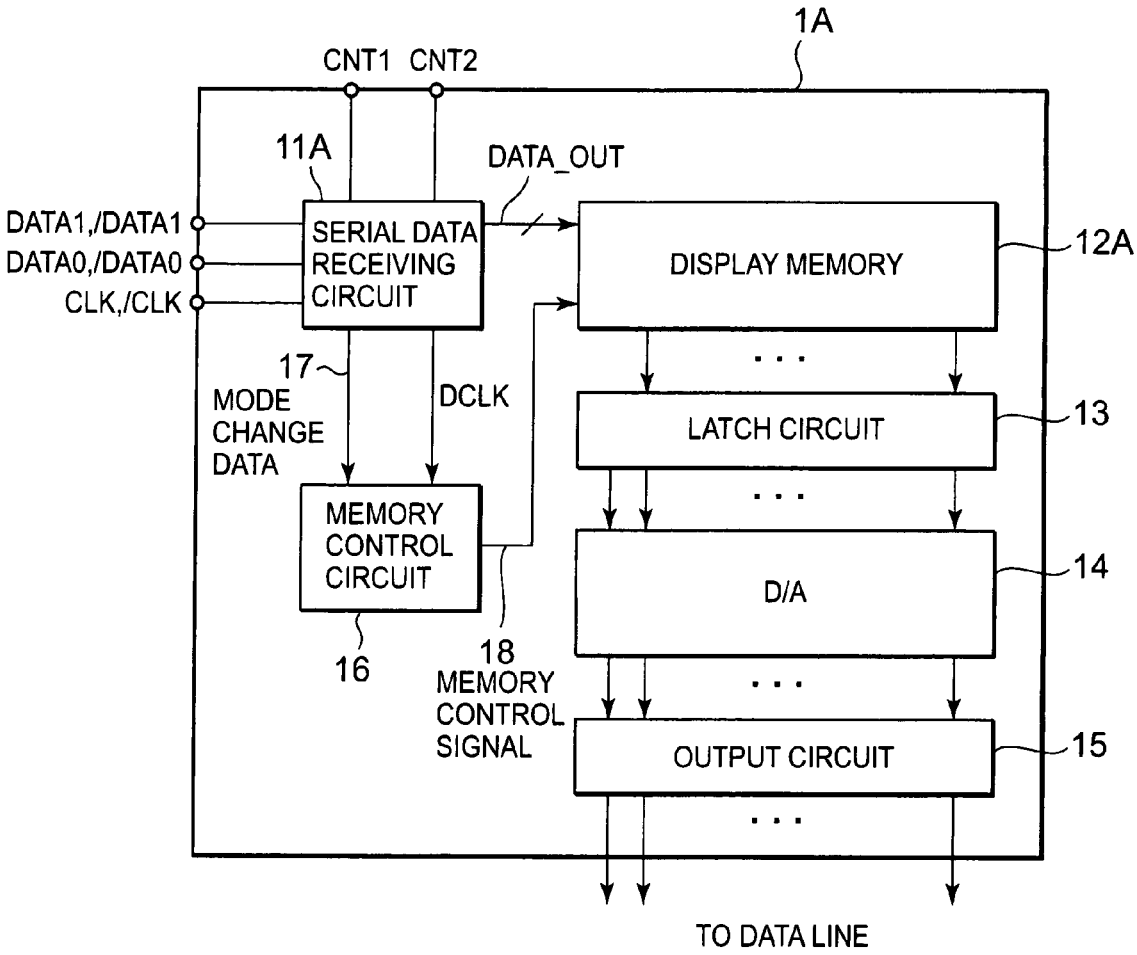
FIG. 8 is a block diagram illustrating a configuration of a data line driver according to the second exemplary embodiment of the present invention.

FIG. 8 is a block diagram illustrating a configuration of a data line driver 1A according to the second exemplary embodiment of the present invention. One feature of the data line driver 1A of the second exemplary embodiment is that it is configured to correspond to an operation which updates only one part of a frame image displayed in a liquid crystal display panel. A frame image displayed in a liquid crystal display panel in a frame period may be frequently almost same as the frame image displayed in the previous frame period. In such a case, the power consumption of the data line driver 1A can be reduced by transmitting display data of the updated part of the frame image to the data line driver 1A.

In addition, when display data of only updated part is selectively transmitted to the data line driver 1A, the transfer rate of the display data can be reduced. The reduction of the transfer rate is preferable because it can increase the certainty of the transmission of display data, and cause a serial data receiving circuit to execute the above operation which reduces the power consumption.

In order to execute such operations, there are provided in the data line driver 1A with a display memory 12A which has such a capacity that display data of one frame image can be stored, and a memory control circuit 16 which controls the display memory 12A. Further, a serial data receiving circuit 11A which executes an operation which is different from that of the serial data receiving circuit 11 is integrated in the data line driver 1A.

In the second exemplary embodiment, the serial data receiving circuit 11A is configured to be able to extract mode change data 17 from the differential serial data signals DATA0, /DATA0, DATA1, and /DATA1. The mode change data 17 is data which designates that display data of whole frame image is transmitted to the data line driver 1A, or display data of only one part of frame image is transmitted. When the display data of only one part of frame image is transmitted, the mode change data 17 includes location data which shows the location of the part in the frame image. The mode change data 17 extracted by the serial data receiving circuit 11A is sent with the dot clock signal DCLK to the memory control circuit 16. The memory control circuit 16 generates a memory control signal 18 and supplies it to the display memory 12A in response to the mode change data 17 and the dot clock signal DCLK. The display memory 12A is controlled in response to the memory control signal 18, so that the display data transmitted to the data line driver 1A by the differential serial data signals DATA0, /DATA0, DATA1, and /DATA1 is written to the address corresponding to the location data in the display memory 12A.

Figure 9:
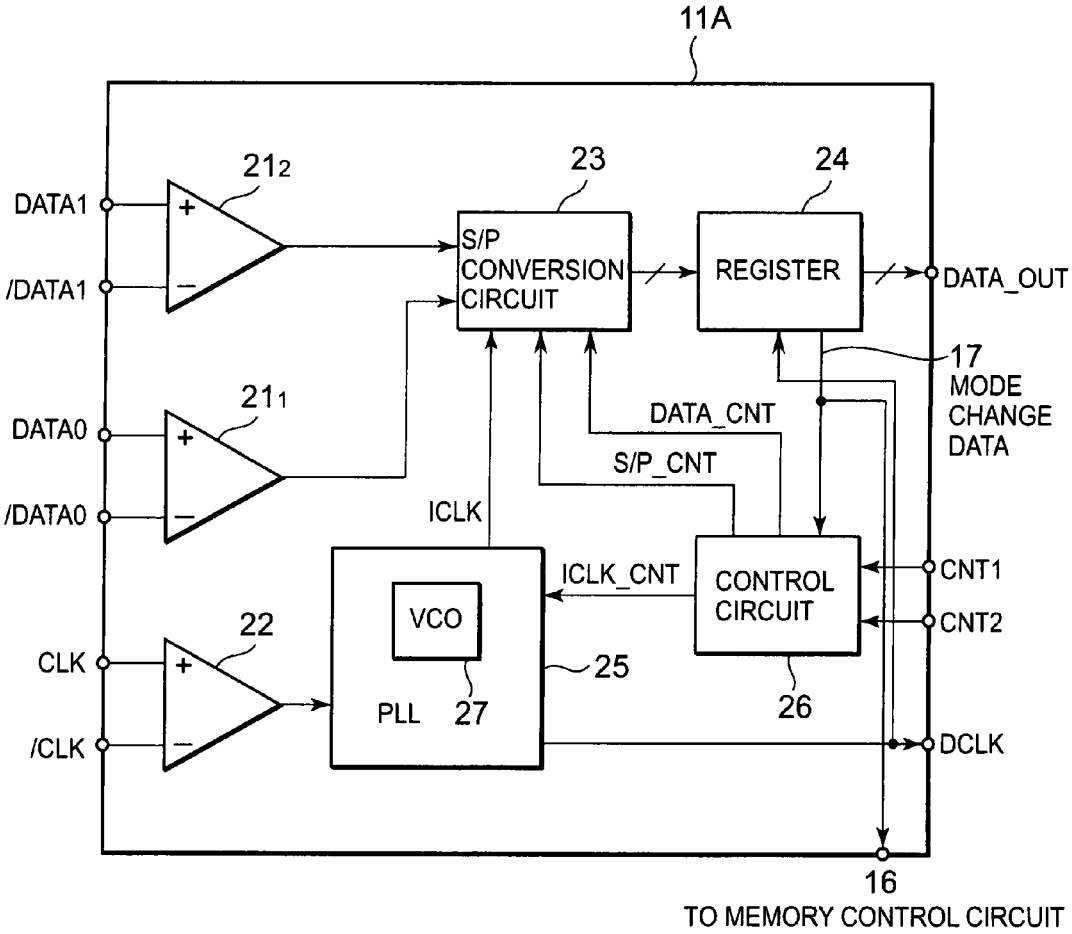
FIG. 9 is a block diagram illustrating a configuration of a serial data receiving circuit according to the second exemplary embodiment.

FIG. 9 is a block diagram illustrating a configuration of the serial data receiving circuit 11A. The configuration of the serial data receiving circuit 11A is almost same as the configuration of the serial data receiving circuit 11 illustrated in FIG. 2. A different point is that a register 24 is configured to extract the mode change data 17 from parallel data signal outputted from the serial/parallel conversion circuit 23, and to transmit the extracted mode change data 17 to the control circuit 26 and the memory control circuit 16. The control circuit 26 controls operations of the serial/parallel conversion circuit 23 and the PLL circuit 25 in response to the mode change data 17 in addition to the external control signals CNT1 and CNT2.

The data line driver 1A of the second exemplary embodiment operates as follows. The mode change data 17 is transmitted to the data line driver 1A in a beginning blanking period of each frame period. More specifically, if a frame period is started, the mode change data 17 is sent to the data line driver 1A in the blanking period, and then display data is sent to the data line driver 1A.

When display data of the whole frame image is transmitted to the data line driver 1A, the memory control circuit 16 controls the display memory 12A so that the whole display memory 12A is updated by the display data transmitted to the data line driver 1A. In this case, the control circuit 26 controls operations of the serial/parallel conversion circuit 23 and the PLL circuit 25 according to the external control signals CNT1 and CNT2. In one exemplary embodiment, both of the external control signals CNT1 and CNT2 are set to "High" level so that a liquid crystal display panel of XGA is driven, the serial/parallel conversion circuit 23 executes a single edge operation, and the PLL circuit 25 is controlled to execute $\alpha$ times (n/2 times) frequency multiplying and generate the internal clock signal ICLK.

On the other hand, when display data of one part of the frame image is transmitted, the memory control circuit 16 controls the display memory 12A so that the transmitted display data is written to the address designated by the location data of the mode change data 17. In this case, in response to that the transfer rate of display data is reduced, the control circuit 26 controls the serial/parallel conversion circuit 23 to execute a double edge operation, and controls the PLL circuit 25 to execute $\alpha/2$ times (n/4 times) frequency multiplying. Thereby, the frequency of the internal clock signal ICLK is reduced into half, and the power consumption of the data line driver 1A is reduced effectively.

As described above, in the second exemplary embodiment, the data line driver 1A is configured to be able to execute an operation which updates only one part of the frame image displayed in a liquid crystal display panel. In addition, when display data of one part of the frame image is transmitted to the data line driver 1A, the serial/parallel conversion circuit 23 is controlled to execute a double edge operation, and the frequency of the internal clock signal ICLK generated by the PLL circuit 25 is reduced into half, thereby, the power consumption of the data line driver 1A is reduced effectively.

Meanwhile, in the second exemplary embodiment, while the mode change data 17 is transmitted by the differential serial data signals DATA0, /DATA0, DATA1, and /DATA1, and the serial/parallel conversion circuit 23 and the PLL circuit 25 are controlled in response to the mode change data 17, a specific control signal corresponding to content of the mode change data 17 can be also supplied from a circuit (typically, LCD controller) which generates the differential serial data signals DATA0, /DATA0, DATA1, and /DATA1 to the data line driver 1A. However, it is preferable in order to decrease the number of the signals which are necessary to control the serial/parallel conversion circuit 23 and the PLL circuit 25 that the mode change data 17 is transmitted by the differential serial data signals DATA0, /DATA0, DATA1, and /DATA1.

While actual exemplary embodiments of the present invention are described above, the present invention should not be understood within limitation of the above exemplary embodiments. For example, in the above exemplary embodiments, while such a configuration is provided that the display data receiving circuit of the present invention is integrated in the data line driver, the display data receiving circuit of the present invention can be also integrated in another circuit receiving display data, for example, LCD controller.

And, in the above exemplary embodiments, while such a configuration is provided that the internal serial data signal IDATA0 is generated from the differential serial data signals /DATA0 and DATA0, and the internal serial data signal IDATA1 is generated from the differential serial data signals /DATA1 and DATA1, single end signals may be used instead of the differential serial data signals. In this case, the internal serial data signals may be generated from the single end signals, and the single end signals may be used as the internal serial data signals.

What is claimed is:

1. A display data receiving circuit, comprising:

a clock regeneration circuit which generates an internal clock signal having an integral multiple of a frequency of an external clock signal in response to said external clock signal; and a serial/parallel conversion circuit which receives a serial data signal as display data in synchronization with said internal clock signal, and generates a parallel data signal by executing a serial/parallel conversion for said serial data signal, wherein said serial/parallel conversion circuit is configured to be able selectively to execute either one of a single edge operation, which receives said serial data signal in response to one of a rising edge and a falling edge of said internal clock signal, and a double edge operation, which receives said serial data signal in response to both of said rising edge and said falling edge of said internal clock signal;

wherein said clock regeneration circuit is configured to be able selectively to change a frequency of said internal clock signal, wherein, if the display data is supplied at a first transfer rate to the display data receiving circuit, the serial/parallel conversion circuit executes the single edge operation, and the frequency of the internal clock signal is set to be a times as high as the frequency of the external clock signal; and wherein, if the display data is supplied at a second transfer rate which is lower than the first transfer rate to the display data receiving circuit, the serial/parallel conversion circuit executes the double edge operation, and the frequency of the internal clock signal is set to be $\alpha/2$ times as high as the frequency of the external clock signal.

2. The display data receiving circuit according to claim 1, further comprising:

a control circuit which controls the clock generation circuit and the serial/parallel conversion circuit in response to a control signal supplied from an external side according to a data transfer rate of the serial data signal, wherein the control circuit controls in response to the control signal selectively to change the single edge operation and the double edge operation in the serial/parallel conversion circuit, and selectively to change the frequency of the internal clock signal generated by the clock generation circuit.

3. The display data receiving circuit according to claim 1, further comprising:

an extracting circuit which extracts mode change data from the parallel data signal; and a control circuit which controls the clock generation circuit and the serial/parallel conversion circuit in response to the mode change data, wherein the control circuit controls in response to the mode change data selectively to change the single edge operation and the double edge operation in the serial/parallel conversion circuit, and selectively to change the frequency of the internal clock signal generated by the clock generation circuit.

4. The display data receiving circuit of claim 1, wherein configuration of the serial/parallel conversion circuit that selectively executes either the single edge operation or the double edge operation and the configuration of the clock regeneration circuit to selectively change the frequency of the internal clock signal provides a mechanism to permit said display data receiving circuit to process any of a plurality of display resolutions of display data in an energy efficient manner.

5. The display data receiving circuit of claim 4, wherein said plurality of display resolutions comprises:

XGA (extended graphic array: 1024 ×768 pixels);

VGA (video graphic array: 640 ×480 pixels);

HVGA (half video graphic array: 480 ×320 pixels); and

QVGA (quarter video graphic array: 320 ×240 pixels).

6. The display data receiving circuit of claim 4, wherein at least one of the serial/parallel conversion circuit and the clock regeneration circuit is controlled dynamically in response to a relative amount of display data that is to be refreshed in a frame, to thereby control a power consumption.

7. The display data receiving circuit of claim 1, wherein the serial data signal received by said serial/parallel conversion circuit comprises one of a plurality of serial data signal inputs for display data received in synchronization with said internal clock signal and said serial/parallel conversion circuit can selectively disable one or more of the received serial data signal inputs.

8. The display data receiving circuit of claim 1, further comprising a memory device that stores parallel data output from said serial/parallel conversion circuit, as a unit of data for display on a display panel.

9. The display data receiving circuit of claim 8, wherein said memory device comprises one of:

a register that stores data in a unit of a line of display data; and a display memory that stores data in a unit of an image frame.

10. The display data receiving circuit of claim 9, wherein said memory device comprises the display memory and a configuration of said a serial/parallel conversion circuit and a configuration of said clock regeneration circuit is controlled based upon whether only a partial frame of image data is updated.

11. The display data receiving circuit of 10, further comprising:

an extracting circuit which extracts mode change data from the parallel data signal; and a control circuit which controls the clock generation circuit and the serial/parallel conversion circuit in response to the mode change data, wherein the control circuit controls in response to the mode change data to selectively change the single edge operation and the double edge operation in the serial/parallel conversion circuit, and to selectively change the frequency of the internal clock signal generated by the clock generation circuit, wherein, if the mode change data directs to transmit display data of a whole one frame image to the display panel driver in a frame period, the control circuit controls the serial/parallel conversion circuit so that the serial/parallel conversion circuit executes the double edge operation, and controls the clock generation circuit so that the frequency of the internal clock signal is $\alpha$ times as high as the frequency of the external clock signal, and wherein, if the mode change data directs to transmit display data of a part of the one frame image to the display panel driver in the frame period, the control circuit controls the serial/parallel conversion circuit so that the serial/parallel conversion circuit executes the double edge operation, and controls the clock generation circuit so that the frequency of the internal clock signal is $\alpha/2$ times as high as the frequency of the external clock signal.

12. The display data receiving circuit of claim 1, wherein said clock regeneration circuit comprises a plurality of frequency generators to thereby provide a plurality of available selectable frequency ranges for said internal clock signal, as selected by a control signal.

13. A display panel driver, comprising:

a display data receiving circuit which receives a serial data signal transmitting display data, and generates a parallel data signal corresponding to the serial data signal; and a driving circuit which drives a display panel in response to the parallel data signal, the display data receiving circuit comprising:

a clock generation circuit which generates an internal clock signal having an integral multiple of a frequency of an external clock signal in response to the external clock signal; and a serial/parallel conversion circuit which receives the serial data signal in synchronization with the internal clock signal, and generates the parallel data signal by executing a serial/parallel conversion for the serial data signal, wherein the serial/parallel conversion circuit is configured to be able selectively to execute either a single edge operation, which receives the serial data signal in response to one of a rising edge and a falling edge of the internal clock signal, and a double edge operation, which receives the serial data signal in response to both of said rising edge and said falling edge of the internal clock signal, wherein the clock generation circuit is configured to be able selectively to change a frequency of the internal clock signal, wherein, if the display data is supplied at a first transfer rate to the display data receiving circuit, the serial/parallel conversion circuit executes the single edge operation, and the frequency of the internal clock signal is set to be $\alpha$ times as high as the frequency of the external clock signal; and wherein, if the display data is supplied at a second transfer rate which is lower than the first transfer rate to the display data receiving circuit, the serial/parallel conversion circuit executes the double edge operation, and the frequency of the internal clock signal is set to be $\alpha/2$ times as high as the frequency of the external clock signal.

14. The display panel driver according to claim 13, further comprising:

an external control pin to which a control signal is supplied according to a data transfer rate of the serial data signal; and a control circuit which controls the clock generation circuit and the serial/parallel conversion circuit in response to a control signal supplied from an external side according to a data transfer rate of the serial data signal, wherein the control circuit controls, in response to the control signal, selectively to change the single edge operation and the double edge operation in the serial/parallel conversion circuit, and selectively to change the frequency of the internal clock signal generated by the clock generation circuit.

15. The display panel driver according to claim 13, further comprising:

a display memory which is configured to be supplied with the parallel data signal, and to be able to store the display data of one frame image, the driving circuit driving the display panel according to the display data stored in the display memory, the display data receiving circuit comprising:

an extracting circuit which extracts mode change data from the parallel data signal; and a control circuit which controls the clock generation circuit and the serial/parallel conversion circuit in response to the mode change data, wherein the control circuit controls, in response to the mode change data, selectively to change the single edge operation and the double edge operation in the serial/parallel conversion circuit, and selectively to change the frequency of the internal clock signal generated by the clock generation circuit.

16. The display panel driver according to claim 15, wherein, if the mode change data directs to transmit display data of a whole one frame image to the display panel driver in a frame period, the control circuit controls the serial/parallel conversion circuit so that the serial/parallel conversion circuit executes the double edge operation, and controls the clock generation circuit so that the frequency of the internal clock signal is a times as high as the frequency of the external clock signal, and if the mode change data directs to transmit display data of a part of the one frame image to the display panel driver in the frame period, the control circuit controls the serial/parallel conversion circuit so that the serial/parallel conversion circuit executes the double edge operation, and controls the clock generation circuit so that the frequency of the internal clock signal is $\alpha/2$ times as high as the frequency of the external clock signal.

17. A display apparatus, comprising:

a display panel; and the display data receiving circuit of claim 1.

18. A display apparatus, comprising:

a display panel; and the display panel driver of claim 13.

* * * * *